US005186156A

United States Patent [19]

Clayton

[11] Patent Number: 5,186,156

[45] Date of Patent: Feb. 16, 1993

[54] AIR OPERATED TOY GUN

[76] Inventor: Richard A. Clayton, 10200 Hillview Ave., Chatsworth, Calif. 91311

[21] Appl. No.: 793,186

[22] Filed: Nov. 18, 1991

[51] Int. Cl.[5] ..... F41B 11/00

[52] U.S. Cl. ..... 124/59; 124/66; 124/67

[58] Field of Search ..... 124/56, 59, 63-68, 124/71, 48, 51.1

[56] References Cited

U.S. PATENT DOCUMENTS

| | | | |
|---|---|---|---|
| 2,237,678 | 4/1941 | Lohr et al. | 124/66 |
| 2,630,795 | 3/1953 | Peters | 124/67 |
| 3,818,887 | 6/1974 | Akiyama et al. | 124/67 |
| 4,004,566 | 1/1977 | Fischer | 124/67 X |
| 4,843,751 | 7/1989 | Ferri | 124/67 X |

FOREIGN PATENT DOCUMENTS

| | | | |
|---|---|---|---|
| 1138340 | 10/1962 | Fed. Rep. of Germany | 124/68 |

*Primary Examiner*—Dennis L. Taylor
*Assistant Examiner*—Jeffrey L. Thompson

[57] ABSTRACT

An air operated toy gun for successively launching a plurality of projectiles is disclosed. Said gun utilizes a movable air nozzle for successive engagement with a plurality of projectile launching barrels. The gun may be used with darts or other projectiles adapted to form a seal with the launching barrels.

20 Claims, 3 Drawing Sheets

AIR OPERATED TOY GUN

BACKGROUND OF THE INVENTION

1. Field of the Invention

The present invention relates to mechanical guns, and more particularly to a novel such gun in which one or more cartridges, each comprising a barrel and a projectile, are sequentially discharged by compressed air delivered from a single air pump assembly.

2. Brief Description of the Prior Art

Single shot toy airguns have been in common use for many years in which a spring operated piston forces air from a chamber and through a barrel to eject a projectile from the barrel (for example, Cagan et al., 4,212,285). More recently, toy airguns have been developed for launching multiple projectiles between loadings, such as Ferri (4,841,655) and Tsao (4,848,307). Difficulties and disadvantages are encountered with the aforementioned designs stemming from the methods of engagement of the airpump with the launching barrels for transfer of compressed air to the projectiles.

Tsao ('307) provides a single airpump for propelling projectiles from a plurality of barrels in a rotating magazine, but provides no air seal between the airpump outlet 401 and barrels 21, and requires a special projectile having an internal air chamber 84 and funnel shaped tail 82 to catch an airstream from the airpump. This allows for significant amounts of air and hence propelling force to be lost in the gap between the airpump outlet 401 and the projectile 8.

Ferri ('655) provides a constant spring bias 14 within a two piece projectile magazine 12A, 12C of expandable length whereby the magazine is always in tight engagement between the gun frame on its forward end and the airpump outlet 18A on its rearward end. This arrangement provides a seal between the magazine chambers 16 and the airpump outlet 18A but yields the undesirable side effect of high friction between the magazine and frame during advancement of the magazine, thus requiring sturdier construction and greater force for operation of the gun. The two effects oppose one another, whereby adjustment of the magazine bias to give a strong air seal generates a gun which is more difficult to operate while adjustment for ease of operation yields a gun with a poor airseal.

SUMMARY OF THE INVENTION

Accordingly, the above problems and difficulties are obviated by the present invention which provides a novel means for sealing the air passage between an airpump and a barrel whereby greater sealing force is applied between airpump and barrel during discharge of the airpump than during advancement of the magazine.

The present invention provides an airpump outlet or nozzle which is movable on the gun frame between a forward "firing" position and a rearward "cocking" position so that the airpump outlet may be engaged and sealed with a barrel of the projectile magazine during the time that air is discharged from the airpump, but may be disengaged and withdrawn from contact with the barrel and magazine during the advancement of said magazine. Since the sealing mechanism (i.e. the movable air outlet) is carried on the frame, implementation is generally independent of magazine configuration (clip, cylinder, ammo belt, etc.) or projectile type (soft-dart, plastic pellet, ball, etc.). This arrangement is quite versatile and variations within the scope of the present invention allow for the construction of a variety of multiple shot airgun configurations including revolvers, clip load pistols, and rifles.

Sealing force to engage and seal the movable air outlet of the present invention to a projectile magazine may be provided by any or all of the following means:

friction of the piston within an airpump forcing the pump body and air outlet forward on the gun frame, toward and against the magazine;

air compressed by the piston against the air outlet forcing the outlet away from the pump body, toward and against the magazine;

spring bias between the gun assembly and the air outlet forcing the air outlet forward on the gun frame, toward and against the magazine.

Retracting force to withdraw the air outlet from engagement with the magazine may be provided by any or all of the following means:

friction of the piston within an airpump dragging the pump body rearward on the gun frame, away from the magazine, during a cocking operation of the airpump;

advancement of the magazine forcing the air outlet out of its path;

bias of a spring between the air outlet and the gun frame forcing the air outlet away from the magazine, said bias being less than the sealing forces applied against it during a firing stroke of the airpump.

Therefore, it is among the primary objectives of the present invention to provide a novel means for sealing the airpump of an air operated toy gun to a plurality of projectile launching tubes or barrels in a magazine.

It is further among the primary objectives of the present invention to provide several novel airgun designs employing variations of the aforementioned novel airpump-to-barrel sealing means.

BRIEF DESCRIPTION OF THE DRAWINGS

The present invention, both as to its organization and manner of operation, together with further objects and advantages thereof, may best be understood with reference to the following description, taken in connection with the accompanying drawings in which.

DESCRIPTION OF EXEMPLARY EMBODIMENTS OF THE INVENTION

Figure 1:
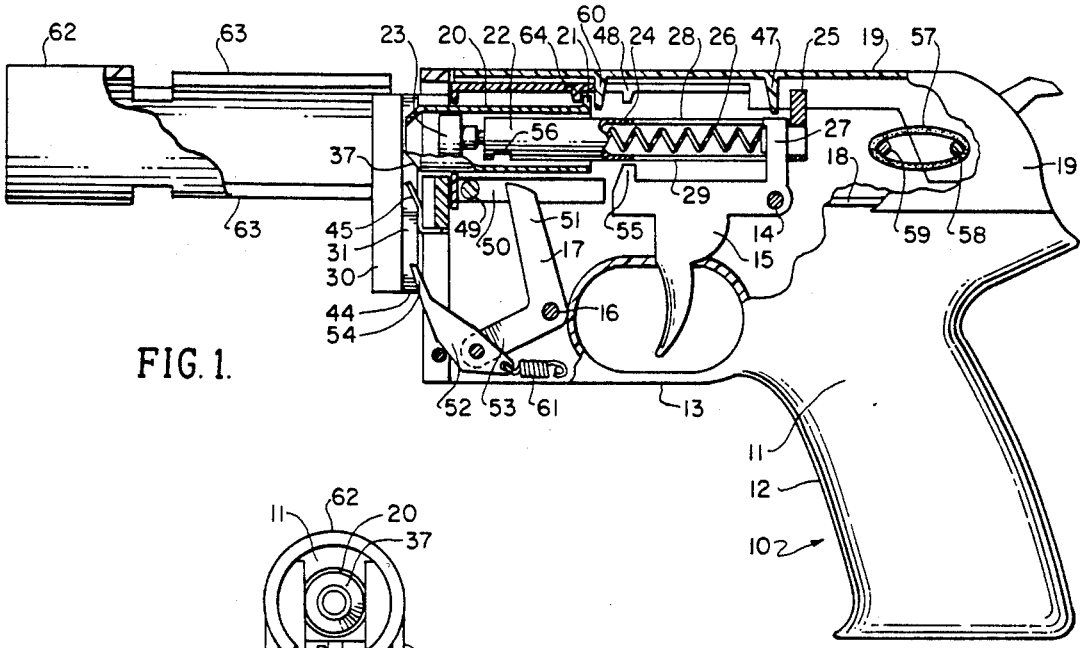
FIG. 1 is a side elevational view, partly in section, of a novel mechanical gun incorporating the present invention.
Figure 2:
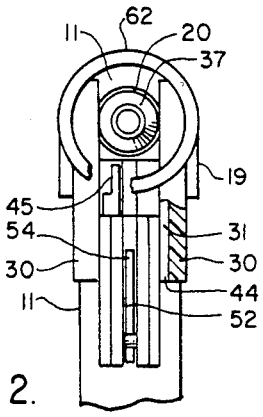
FIG. 2 is an end elevational view, partly in section of the mechanical gun of FIG. 1.
Figure 3:
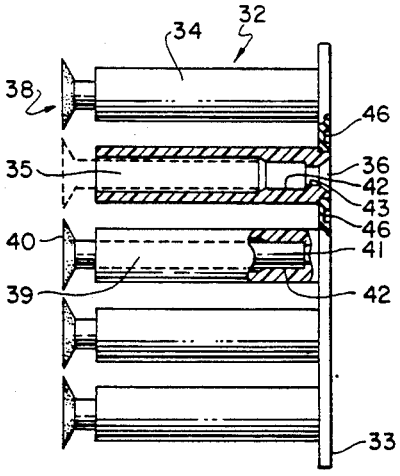
FIG. 3 is a side view, partly in section, of a projectile magazine for the gun of FIG. 1.
Figure 4:
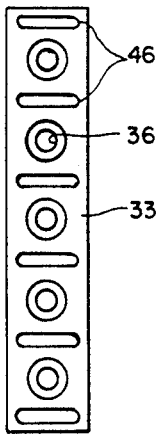
FIG. 4 is an end elevational view of the projectile magazine taken in the direction of arrows 4—4 of FIG. 3.

Referring to FIG. 1, there is shown by way of illustration, but not of limitation, a mechanical pistol 10 designed and constructed in accordance with this invention. The pistol includes a frame 11, having a handle 12, trigger guard 13, a shaft 14 for pivotally mounting a trigger 15, a shaft 16 for pivotally mounting a magazine advancement arm 17, and guides 18 for carrying a slide assembly 19 for forward and rearward travel between a forward position and a rearward position. Carried within the frame 11 are a cylinder 20 having a protruding flange 21, and a plunger 22 comprising a head 23, and a hollow shaft 24 having a protruding shoulder 25. Both the cylinder 20 and the plunger 22 are movably supported by interior surfaces of the frame 11 for forward and reverse travel longitudinally within the frame 11. A spring 26 is carried within the plunger 22 such that one end of the spring rests at the forward end of the hollow shaft 24 and the other end of the spring 26 rests against an arm 27 of trigger 15 which protrudes into the interior of the hollow shaft 24 through a pair of slots 28, 29. In its uncocked state, as depicted in FIG. 1, the plunger 22 is in its most forward position so that the arm 27 is near the rearward end of the hollow shaft 24.

Guides 30, having slots 31, are attached to the frame 11 at its forward end for insertably and removably receiving a projectile magazine 32. The magazine 32 comprises a baseplate 33 to which a plurality of elongated barrels 34 are attached. Each barrel 34 has a central passageway 35, open at both ends. The rearward opening 36 is beveled to mate smoothly with the beveled tip 37 of cylinder 20. Each barrel receives within its central passageway 35 a projectile 38 having a shaft 39 with an enlarged head 40 at the forward end of the shaft 39. The rearward end 41 of the shaft 39 rests at the rearward end of the barrel 34 at a section 42 of the passageway 35 having a reduced diameter relative to the more forward portion of the passageway. The rearward end 41 of the shaft 39 has a circular transverse cross section of a diameter which yields a snug and generally airtight fit within the reduced diameter section 42. Another reduced diameter section 43 of the passageway 35 serves to prevent the rearward end 41 of the shaft from exiting the rearward opening 36 of the barrel.

Magazine 32 is loaded into the pistol 10 by insertion of one end of the baseplate 33 into the lower end 44 of the slots 31 of guides 30 until the inserted end of the baseplate 33 contacts the forward end of cylinder 20 which in rest position as shown in FIG. 1 protrudes into the path of the baseplate 33 whereby further insertion is prevented. At this point a spring latch 45 engages the uppermost slot 46 on baseplate 33 to prevent downward movement of the magazine 32.

The pistol 10 is cocked and the magazine 32 is advanced as follows: An operator grips the handle 12 with one hand and draws the slide assembly 19 rearward with his/her other hand. A shoulder 47 on the interior surface of the slide 19 engages the shoulder 25 of the plunger 22 causing the plunger to travel rearward within frame 11, thereby compressing spring 26 against arm 27 of trigger 15. As the plunger 22 moves rearward, friction between the head 23 and the interior surface of cylinder 20 drags cylinder 20 rearward such that the forward end of cylinder 20 is withdrawn from the upward path of baseplate 33. Once the cylinder 20 is clear of the slots 31 a shoulder 48 on the frame 11 engages the flange 21 of the cylinder to prevent further rearward movement of the cylinder 20. Additionally, once the cylinder 20 is clear of the slots 31 a shaft 49 on the slide 19, protruding to the interior of frame 11 through a pair of slots 50 of the frame, engages the upper member 51 of the magazine advancement arm 17. As the slide 19 is drawn further rearward the shaft 49 pivots the arm 17 about shaft 16. A pawl 52 pivotally mounted on the lower member 53 of arm 17 is raised upward whereby the tip 54 of pawl 52 engages a slot 46 of baseplate 33 to force the magazine 32 upward. As the slide 19 reaches its most rearward position, magazine 32 is raised to a point where the slot 46 currently engaged by pawl 52 becomes engaged by spring latch 45. Additionally, the plunger 22 reaches its most rearward position whereby a hook 55 on the trigger 15 becomes aligned with a hole 56 in the hollow shaft 24. Compression of the spring 26 against arm 27 pivots trigger 15 about shaft 14 such that the hook 55 engages the rim of the hole 56 to prevent the plunger 22 from moving in the forward direction when the slide 19 is returned forward. An elastic band 57 attached to a shaft 58 on the slide and to a shaft 59 on the frame, having been stretched by the rearward travel of the slide 19, serves to return the slide 19 forward upon release by the operator. As the slide 19 approaches its forward most position a shoulder 60 engages flange 21 of the cylinder to move the cylinder 20 forward until the forward beveled tip 37 engages the beveled rearward opening 36 of the barrel 34 currently aligned in the firing position to form a generally airtight seal between the cylinder 20 and the barrel 34. A spring 61 engaged between frame 11 and pawl 52 returns the pawl 52 and the magazine advancement arm 17 to their rest positions as depicted in FIG. 1.

Once cocked, the pistol 10 may be fired by pivoting the trigger 15 about shaft 14 to disengage hook 55 from hole 56 thus allowing the compressed spring 26 to expand, thrusting plunger 22 forward to compress air within the closed space formed by cylinder 20, head 23, barrel 34 and the rearward end 41 of projectile 38. Friction between plunger head 23 and the interior surface of cylinder 20 urges cylinder 20 forward, thus reinforcing the seal between cylinder 20 and barrel 34. The frictional bond between projectile 38 and barrel 34 is designed to be the weakest seal in the system such that when the air pressure reaches a sufficient magnitude within cylinder 20 and barrel 34 the bond is broken and the projectile 38 is ejected from the barrel 34.

After firing, the pistol 10 may once again be cocked and the magazine advanced as previously described. Once the projectiles 38 have all been launched the empty magazine 32 is removed from the pistol 10 by manually lifting the magazine upward and out of slots 31. In the absence of the magazine 32, a shoulder 64 retains cylinder 20 within frame 11.

A false barrel 62 is carried at the forward end of the frame 11 for cosmetic purposes. The inside diameter of the false barrel 62 is larger than the diameter of the enlarged head 40 of the projectile 38 such that no contact is made between the projectile 38 and the false barrel 62 at any time before, during or after projectile launch. Slots 63 are provided top and bottom on false barrel 62 to allow passage of projectiles 38, barrels 34 and baseplate 33 during magazine advancement.

Figure 5:
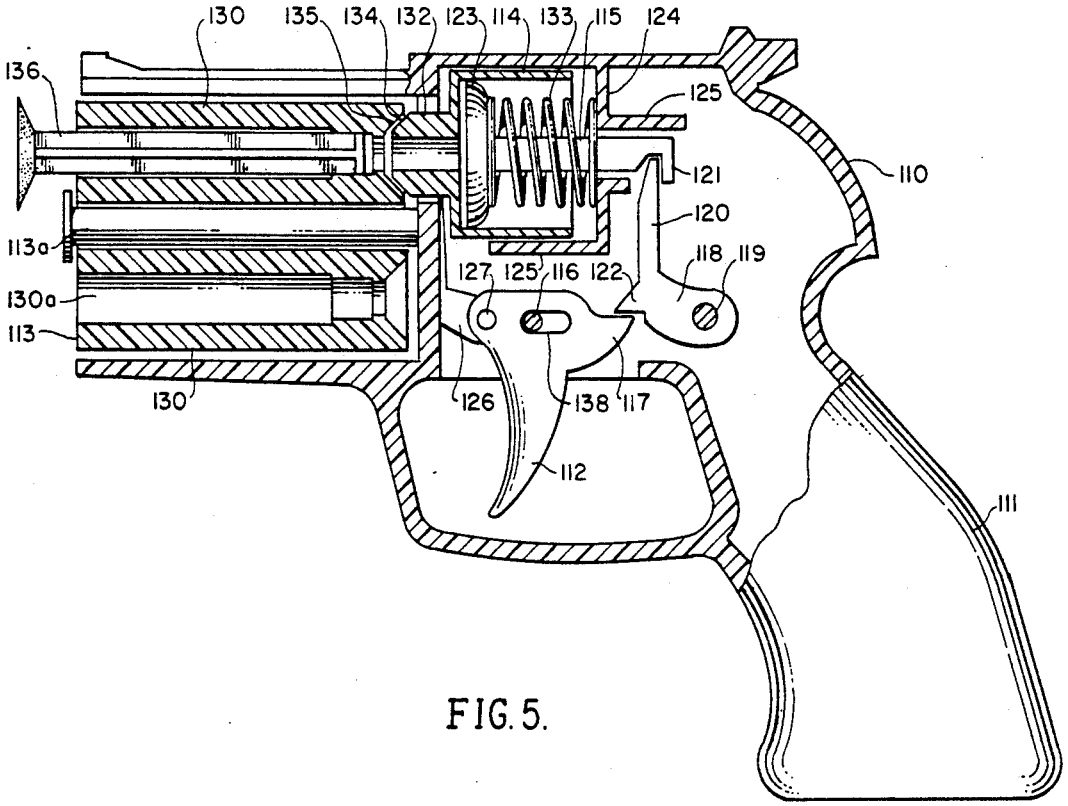
FIG. 5 is a side elevational view, partly in section, of another novel mechanical gun incorporating the present invention.

With reference to FIG. 5, it may be seen that the present invention may also be incorporated in a revolver format. Similar to the previously described version, the revolver comprises a frame 110 having a handle 111, a trigger 112, a projectile magazine 113, a cylinder 114 slidingly carried on the frame, and a piston assembly 115 within the cylinder. The magazine 113 is rotatably carried about a mounting shaft 113*a* on the frame 110. The trigger 112 is pivoted on the frame 110 about a shaft 116 and comprises a pawl-like shoulder 117 for engagement with a lever assembly 118. The lever assembly 118 is pivotally mounted to frame 110 about a shaft 119 and comprises a member 120 which engages a flange 121 of the piston assembly 115 and a member 122 which engages shoulder 117 of the trigger.

Actuation of the trigger (i.e., inducement of pivotal motion to the trigger 112 in a counterclockwise direction in FIG. 5) forces lever assembly 118 to pivot about shaft 119 whereby member 120 engages flange 121 to draw piston assembly 115 rearward (to the right in FIG. 5) within cylinder 114. Frictional force of the piston head 123 against the interior surface of cylinder 114 pulls the cylinder rearward until the cylinder engages a stop 124. Guides 125 keep the cylinder in a horizontal alignment within the frame 110.

Figure 6:
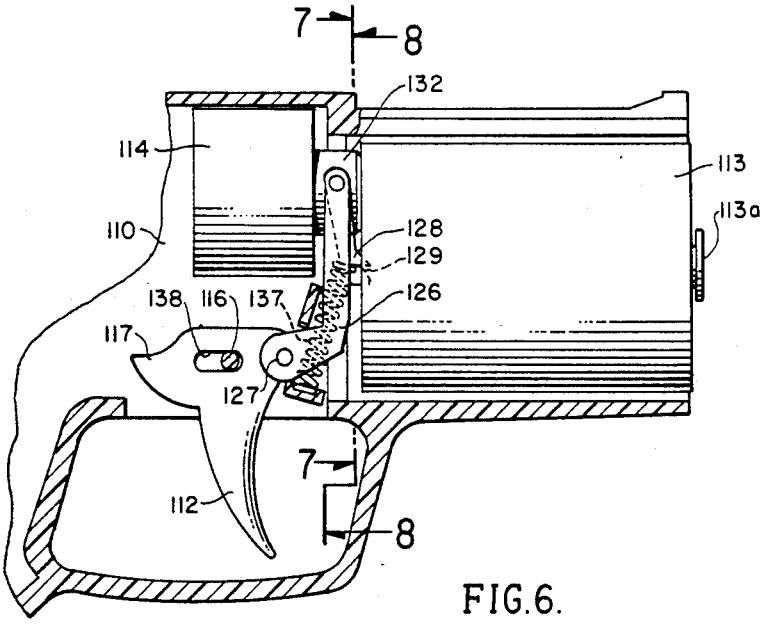
FIG. 6 is a partial elevational view, partly in section, of the reverse side of the gun of FIG. 5.
Figure 7:
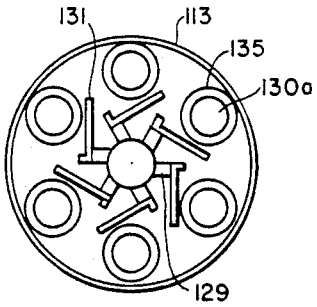
FIG. 7 . is an end elevational view of the projectile magazine taken in the direction of arrows 7—7 of FIG. 6.
Figure 8:
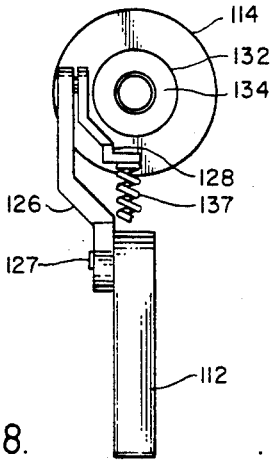
FIG. 8 is an end elevational view of the air cylinder and magazine advancement components taken in the direction of arrows 8—8 of FIG. 6.
Figure 9:
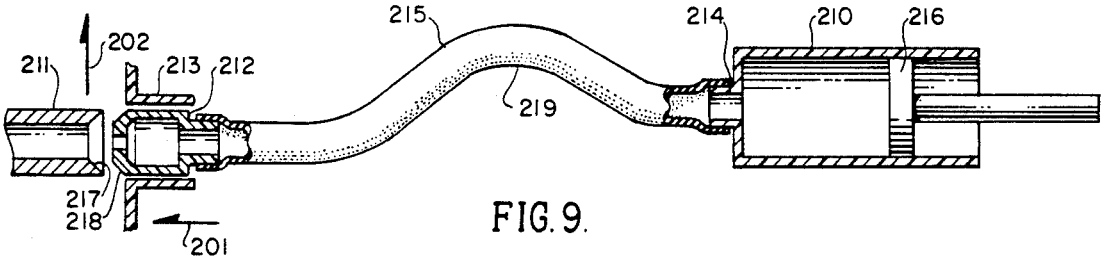
FIG. 9 is a side sectional view of an air cylinder, nozzle and barrel for a toy rifle incorporating the present invention.

Actuation of the trigger 112 additionally precipitates advancement of magazine 113 to align a projectile barrel 130 and barrel passageway 130A with the cylinder 114. With reference to FIG. 6, clockwise motion of trigger 112 pulls an arm 126 downward, said arm being pivotally mounted to trigger 112 by a shaft 127. A pawl 128 is pivoted on the upper end of arm 126 and urged by a spring 137 to engage a set of ratchet teeth 129 on the rear face of magazine 113 whereby said downward movement of arm 126 imparts rotational force to the magazine. It is noted that cylinder 114 is simultaneously being drawn rearward by piston 123 so that the nozzle 132 will not interfere with magazine movement. The number of ratchet teeth 129, and their dimensions, are adapted to cooperate with said movement of arm 126 to normally advance the magazine 113 by the distance between two adjacent barrels 130, in response to the normal firing stroke of trigger 112. A guide 131 is provided at each ratchet tooth to engage the pawl 128 to prevent rotation of magazine 113 beyond the point of barrel 130 to nozzle 132 alignment. A spring latch (not shown) may also be provided which engages the ratchet teeth 129 to prevent rotation of magazine 113 in the direction opposite that imparted by the previously described advancement sequence.

As the trigger 112 is (referring again to FIG. 5) pivoted counterclockwise, it approaches a firing position which may be defined as the position at which angular displacements of the trigger 112 and lever assembly 118 cause shoulder 117 of the trigger and member 122 of the lever assembly to disengage one another. Once said disengagement occurs, the lever assembly 118 and the piston assembly 115, 121, 123 are driven toward their original positions (as depicted in FIG. 5) by a spring 133. Frictional force of the piston 123 against the cylinder 114 drives the cylinder and nozzle 132 forward to engage the beveled end 134 of the nozzle with the beveled rear end 135 of the barrel 130. Air pressure generated by the piston 123 tends to additionally force the cylinder 114 away from the piston 123, thereby reinforcing the seal between nozzle 132 and barrel 130. Finally, the pressurized air is forced by piston 123 through nozzle 132 into passageway 130A to eject the projectile 136.

When the trigger 112 is released after passing said firing position, the spring 137, having been compressed by downward movement of pawl 128, expands to return pawl 128 up and over the next ratchet tooth 129 and to return arm 126 and trigger 112 to their rest positions as in FIGS. 5 and 6. A slotted mounting hole 138 allows trigger 112 to slide forward about shaft 116 to allow shoulder 117 to pass over member 122 of the lever assembly 118 during this retraction stroke.

Other embodiments of the present invention are depicted in FIGS. 9, 10, 11 and 12. The configuration of FIG. 9 may be used to construct a rifle incorporating the invention in which a cylinder 210 and a barrel 211 are held in fixed relationship by a frame (not shown), and a nozzle 212 is slidingly carried by guides 213 on the frame. The nozzle 212 is attached to the outlet 214 of the cylinder 210 by a flexible tube 215 having a service loop 219. When air is pressurized and expelled from the cylinder 210 by a piston 216, it urges the nozzle 212 away from the piston (in the direction of arrow 201) and into engagement with the barrel 211 so that air is forced through the barrel. If the barrel is later moved in the direction of arrow 202, as might be the case for advancement of a projectile magazine, the force of beveled edge 217 of the barrel 211 against beveled edge 218 of the nozzle 212 will urge the nozzle rearward (opposite to the direction of arrow 201) so that the nozzle does not interfere with magazine advancement.

Figure 10:
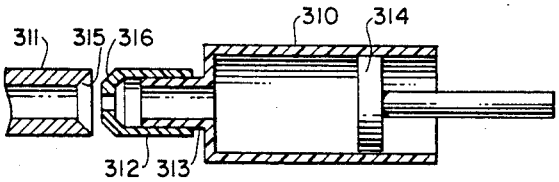
FIG. 10 is a side sectional view of an air cylinder, nozzle and barrel for a variation of the present invention.

FIG. 10 shows a cylinder 310 and a barrel 311 held in fixed relationship by a frame (not shown), and a nozzle 312 slidingly carried on the outlet 313 of the cylinder 310. When air is pressurized and expelled from the cylinder 310 by a piston 314, it urges the nozzle 312 away from the piston (in the direction of arrow 201) and into engagement with the barrel 311 so that air is forced through the barrel. Once again, if the barrel 311 is later moved in the direction of arrow 202, contact between the beveled edges 315 and 316 of the barrel and nozzle, respectively, will force the nozzle 312 rearward to allow unhindered magazine advancement.

Figure 11:
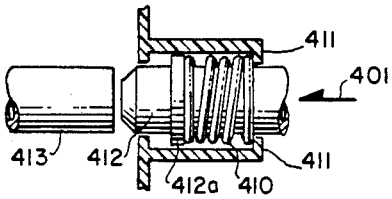
FIG. 11 is a nozzle and barrel combination having spring biased engagement.
Figure 12:
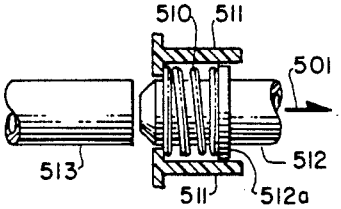
FIG. 12 is a nozzle and barrel combination having spring biased disengagement.

FIGS. 11 and 12 depict spring assisted nozzle movements which may be desirable in some applications of the present invention, depending upon other design variables. In FIG. 11 a spring 410 is biased between a frame 411 and a shoulder 412*a* of a nozzle 412 to normally urge the nozzle into contact with a barrel 413 (in the direction pointed by arrow 401). This strengthens the seal between nozzle 412 and barrel 413 during discharge of air through the nozzle and barrel, but requires that retracting forces applied to nozzle 412 (opposite to the direction indicated by arrow 401) during a magazine advancement operation be greater than the force applied by the spring 410.

In FIG. 12 a spring 510 is biased between a frame 511 and a shoulder 512*a* of a nozzle 512 to normally urge the nozzle away from a barrel 513 (in the direction indicated by arrow 501). Employed in a gun with a multiprojectile magazine, this insures unimpeded magazine advancement, but requires that sealing forces applied to the nozzle 512 (opposite the direction indicated by arrow 501) during discharge of pressurized air through the nozzle 512 and barrel 513 be greater than the force applied by the spring 510.

While particular embodiments of the present invention have been shown and described, it will be obvious to those skilled in the art that changes and modifications may be made without departing from this invention in its broader aspects and therefore the aim in the appended claims is to cover all such modifications as fall within the true spirit and scope of this invention.

What is claimed is:

1. An air operated toy gun comprising:

a frame;

an air chamber carried on said frame;

said chamber having an air outlet path adapted to conduct airflow from said chamber through a nozzle;

said nozzle being movably carried on said frame for motion between a cocking position and a firing position;

a magazine movably carried on said frame and comprising a plurality of barrels in spaced relationship;

each of said barrels comprising an elongated passageway open at both ends;

said magazine movable on said frame whereby said barrels are selectively alignable with said nozzle to allow airflow from said nozzle through said passageway;

a piston in said air chamber having a shape complementary to said air chamber;

means for propelling said piston through a firing stroke within said chamber to displace air under pressure from said chamber through said nozzle;

means urging said nozzle into said firing position during said piston firing stroke to engage said nozzle with a selected barrel, said barrel and said nozzle being adapted to form a substantially airtight seal with each other;

each said barrel adapted to carry a projectile and to form a substantially airtight seal with said projectile to normally prevent airflow through said barrel;

said airtight seal between said nozzle and said barrel being able to withstand a higher magnitude of air pressure than said airtight seal between said projectile and said barrel such that application of elevated air pressure within said barrel will cause breakdown of said seal between said projectile and said barrel prior to a substantial breakdown of said seal between said nozzle and said barrel for the desired result of said projectile being ejected from said barrel by force of said air pressure.

2. The invention as defined in claim 1 wherein:

said nozzle and said chamber are rigidly joined as a single assembly movably carried on said frame for travel between said cocking position and said firing position.

3. The invention as defined in claim 2 wherein:

said means urging said nozzle into said firing position is the frictional force applied to said chamber by said piston during said firing stroke.

4. The invention as defined in claim 1 wherein:

said air outlet path from said chamber to said nozzle is provided by a flexible tube.

5. The invention as defined in claim 1 wherein:

said means urging said nozzle into said firing position is a spring engaged between said nozzle and said frame.

6. The invention as defined in claim 1 including:

a slide element operably carried on said frame for reciprocating motion between a forward position and a rearward position;

a shoulder on said cylinder engageable with said slide element whereby said slide element when in said forward position forces said cylinder to said firing position.

7. The invention as defined in claim 1 wherein:

said means urging said nozzle into said firing position is the elevated air pressure within said chamber and said nozzle created by said firing stroke of said piston.

8. The invention as defined in claim 1 including:

means for advancing said magazine to successively align said barrels with said nozzle.

9. The invention as defined in claim 8 including:

means urging said nozzle toward said cocking position during actuation of said magazine advancing means whereby said nozzle is disengaged from said barrel.

10. The invention as defined in claim 9 wherein:

said nozzle and said chamber are rigidly joined as a single assembly;

said means urging said nozzle toward said cocking position provided by frictional force between said piston and said chamber as said piston is cocked against said propelling means.

11. The invention as defined in claim 9 wherein:

said means urging said nozzle toward said cocking position is provided by frictional. force between said magazine and said nozzle as said magazine is advanced.

12. The invention as defined in claim 8 wherein:

said magazine advancement means comprises a lever assembly pivotally carried on said frame and a plurality of ratchet surfaces on said magazine;

one member of said lever assembly carrying a pawl for engagement with said ratchet surfaces whereby pivotal motion of said lever assembly in one direction causes said magazine to move on said frame to effect said advancement, and pivotal movement of said lever assembly in the other direction retracts said pawl without imparting motion to said magazine.

13. The invention as defined in claim 12 including:

a unidirectional latch carried on said frame for engagement with said magazine to allow motion of said magazine in the direction imparted by said lever assembly and to prevent motion of said magazine in the opposite direction.

14. The invention as defined in claim 12 including:

a slide element operably carried for reciprocating movement on said frame;

said slide element engageable with said lever assembly to induce said pivotal movement of said lever assembly to effect said magazine advancement upon manual actuation of said slide element.

15. The invention as defined in claim 14 including:

a latch to hold said piston cocked against said propelling means;

a trigger for releasing said latch to actuate said piston propelling means;

said slide element when moved in the rearward direction being engageable with said piston so as to draw said piston rearward for engagement with said latch.

16. The invention as defined in claim 8 including:

a trigger movably carried on said frame for actuation of said piston propelling means;

said magazine advancement means comprising a pawl carried on said trigger and a plurality of ratchet surfaces on said magazine;

said pawl being engageable with said ratchet surfaces whereby motion of said trigger in one direction is translated into advancing motion of said magazine.

17. The invention as defined in claim 16 including:

a cocking assembly comprising a pair of levers coupled about a pivot and operably carried on said frame;

said trigger being pivotally carried on said frame for travel between a rest position and a firing position, and provided with a shoulder engageable with one of said levers whereby pivotal motion of said trigger toward said firing position induces pivotal motion of said cocking assembly;

the other of said levers being engageable with said piston whereby said pivotal motion of said cocking assembly draws said piston rearward against said propelling means until angular displacement of said cocking assembly no longer allows simultaneous engagement of said cocking assembly with both said piston and said shoulder whereby said propelling means is allowed to drive said piston forward through said firing stroke.

18. An air operated dart gun comprising:

a frame;

an elongated air cylinder movably carried on said frame for forward and reverse travel between a cocking position and a firing position;

said air cylinder comprising a nozzle to allow air to exit said cylinder;

a piston movably carried in said air cylinder;

a spring normally biasing said piston within said cylinder toward said nozzle;

a magazine movably carried on said frame;

said magazine comprising a plurality of dart barrels in spaced relationship;

said barrels being selectively alignable with said nozzle of said air cylinder;

one end of each said barrel being adapted to be engageable with said nozzle to form a substantially airtight seal when said air cylinder is in said firing position;

the other end of each said barrel being adapted to receive a projectile so as to form a substantially airtight seal between said barrel and said projectile;

means for drawing said piston rearward away from said magazine and against said spring bias; friction of said rearward moving piston within said cylinder dragging said cylinder rearward to said cocking position to disengage said nozzle from said selected barrel;

means for drawing said piston further rearward to engage a latch, said latch holding said piston against said spring bias;

a trigger for releasing said latch to allow said spring bias to propel said piston forward within said cylinder toward said nozzle;

said cylinder being urged forward toward said firing position by friction of said piston moving within whereby said nozzle is forcibly engaged with said selected barrel;

said piston furthermore displacing air from said cylinder through said nozzle to eject said projectile from said selected barrel.

19. The invention as defined in claim 18 including:

means for advancing said magazine to successively align said barrels with said nozzle;

said magazine advancing means comprising a lever assembly pivotally carried on said frame and a plurality of ratchet surfaces on said magazine;

one member of said lever assembly carrying a pawl for engagement with said ratchet surfaces whereby pivotal motion of said lever assembly in one direction causes said magazine to move on said frame to effect said advancement, and pivotal movement of said lever assembly in the other direction retracts said pawl without imparting motion to said magazine.

20. The invention as defined in claim 19 wherein:

said means for drawing said piston rearward comprises a slide element operably carried for reciprocating movement on said frame;

said slide element when moved in the rearward direction being engageable with said piston so as to draw said piston rearward for engagement with said latch.

said slide element engageable with said lever assembly to induce said pivotal movement of said lever assembly to effect said magazine advancement upon manual actuation of said slide element.

* * * * *

US005186156B1

REEXAMINATION CERTIFICATE (3155th)

United States Patent [19] [11] B1 5,186,156

Clayton [45] Certificate Issued Mar. 11, 1997

[54] AIR OPERATED TOY GUN

[76] Inventor: Richard A. Clayton, 10200 Hillview Ave., Chatsworth, Calif. 91311

Reexamination Request:
No. 90/003,284, Dec. 20, 1993

Reexamination Certificate for:

| | |
|---|---|
| Patent No.: | **5,186,156** |
| Issued: | **Feb. 16, 1993** |
| Appl. No.: | **793,186** |
| Filed: | **Nov. 18, 1991** |

[51] Int. Cl.[6] ..... F41B 11/00; F41B 11/14
[52] U.S. Cl. ..... 124/59; 124/66; 124/67
[58] Field of Search ..... 124/48, 51.1, 56, 124/59, 63–68, 71

[56] References Cited

U.S. PATENT DOCUMENTS

| | | | |
|---|---|---|---|
| 2,237,678 | 4/1941 | Lohr et al. . | |
| 2,630,795 | 3/1953 | Peters | 124/67 |
| 3,111,121 | 11/1963 | Baggott | 124/67 |
| 3,205,883 | 9/1965 | Metcalf | 124/67 |
| 3,540,426 | 11/1970 | Lohr et al. . | |
| 3,818,887 | 6/1974 | Akiyama et al. . | |
| 3,913,553 | 10/1975 | Braughler et al. . | |
| 4,004,566 | 1/1977 | Fischer | 124/67 X |
| 4,422,433 | 12/1983 | Milliman | 124/74 |
| 4,732,136 | 3/1988 | Ferri | 124/67 |
| 4,843,751 | 7/1989 | Ferri | 124/67 X |
| 4,986,251 | 1/1991 | Lilley | 124/67 |

FOREIGN PATENT DOCUMENTS

| | | | |
|---|---|---|---|
| 1138340 | 10/1962 | Germany | 124/68 |

OTHER PUBLICATIONS

Edison Toys "Secret Agent" gun, with packaging showing Copyright date of 1983, and printing date of Apr. 1990.

*Primary Examiner*—John Ricci

[57] ABSTRACT

An air operated toy gun for successively launching a plurality of projectiles is disclosed. Said gun utilizes a movable air nozzle for successive engagement with a plurality of projectile launching barrels. The gun may be used with darts or other projectiles adapted to form a seal with the launching barrels.

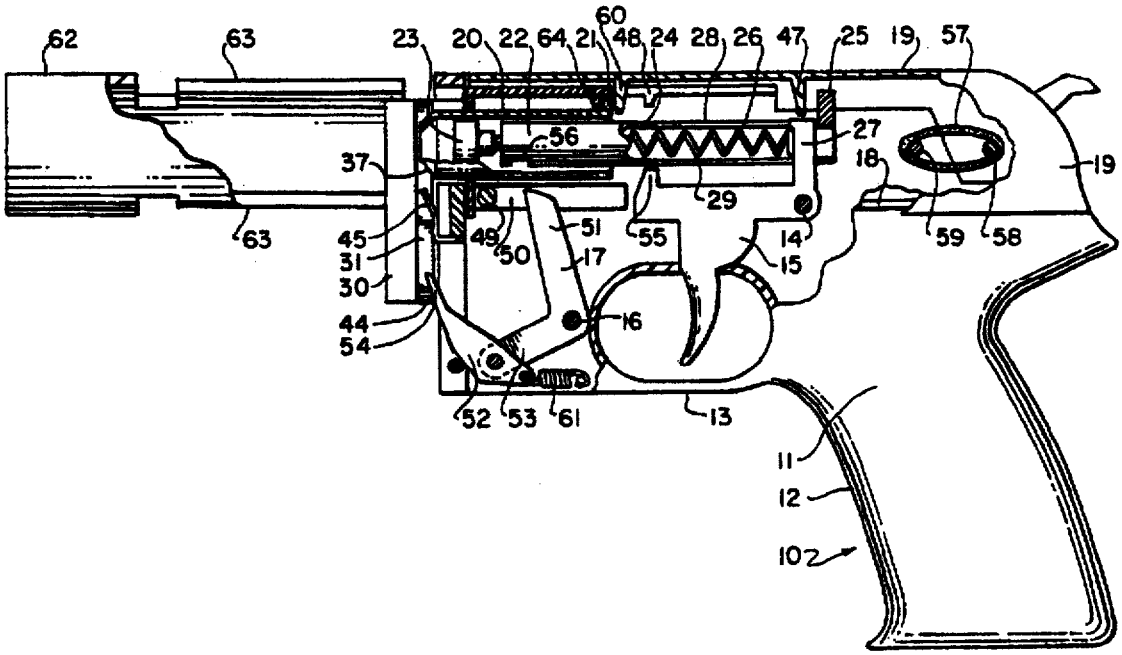

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2–6, 9–11, 14–20 is confirmed.

Claims 1, 7, 8, 12 and 13 are cancelled.

New claims 21–38 are added and determined to be patentable.

*21. An operated toy gun comprising:*

*a frame;*

*an air chamber carried on said frame;*

*said chamber having an air outlet path adapted to conduct airflow from said chamber through a nozzle;*

*said nozzle being movably carried on said frame for motion between a cocking position and a firing position;*

*a magazine movably carried on said frame and comprising a plurality of barrels in spaced relationship;*

*each of said barrels comprising an elongated passageway open at both ends;*

*said magazine movable on said frame whereby said barrels are selectively alignable with said nozzle to allow airflow from said nozzle through said passageway;*

*a piston in said air chamber having a shape complementary to said air chamber;*

*means for retracting said piston within said chamber;*

*means for propelling said piston through a firing stroke within said chamber to displace air under pressure from said chamber through said nozzle;*

*means for moving said nozzle into said cocking position as said piston is retracted within said chamber, said nozzle being disengaged from said magazine in said cocking position;*

*means urging said nozzle into said firing position during said piston firing stroke to engage said nozzle with a selected barrel, said barrel and said nozzle being adapted to form a substantially airtight seal with each other;*

*each said barrel adapted to carry a projectile and to form a substantially airtight seal with said projectile to normally prevent airflow through said barrel;*

*said airtight seal between said nozzle and said barrel being able to withstand a higher magnitude of air pressure than said airtight seal between said projectile and said barrel such that application of elevated air pressure within said barrel will cause breakdown of said seal between said projectile and said barrel prior to a substantial breakdown of said seal between said nozzle and said barrel for the desired result of said projectile being ejected from said barrel by force of said air pressure.*

*22. The invention as defined in claim 21 wherein:*

*said nozzle and said chamber are rigidly joined as a single assembly movably carried on said frame for travel between said cocking position and said firing position.*

*23. The invention as defined in claim 22 wherein:*

*said means urging said nozzle into said firing position is the frictional force applied to said chamber by said piston during said firing stroke.*

*24. The invention as defined in claim 21 wherein:*

*said air outlet path from said chamber to said nozzle is provided by a flexible tube.*

*25. The invention as defined in claim 21 wherein said means urging said nozzle into said firing position comprises a spring.*

*26. The invention as defined in claim 21 including:*

*a slide element operably carried on said frame for reciprocating motion between a forward position and a rearward position;*

*a shoulder on said chamber engageable with said slide element whereby said slide element when in said forward position forces said chamber to said firing position.*

*27. The invention as defined in claim 21 wherein:*

*said means urging said nozzle into said firing position is the elevated air pressure within said chamber and said nozzle created by said firing stroke of said piston.*

*28. The invention as defined in claim 21 including:*

*means for advancing said magazine to successively align said barrels with said nozzle.*

*29. The invention as defined in claim 28 including:*

*means urging said nozzle toward said cocking position during actuation of said magazine advancing means whereby said nozzle is disengaged from said barrel.*

*30. The invention as defined in claim 29 wherein:*

*said nozzle and said chamber are rigidly joined as a single assembly;*

*said means urging said nozzle toward said cocking position provided by frictional force between said piston and said chamber as said piston is cocked against said propelling means.*

*31. The invention as defined in claim 29 wherein:*

*said means urging said nozzle toward said cocking position is provided by frictional force between said magazine and said nozzle as said magazine is advanced.*

*32. The invention as defined in claim 28 wherein:*

*said magazine advancement means comprises a lever assembly pivotally carried on said frame and a plurality of ratchet surfaces on said magazine;*

*one member of said lever assembly carrying a pawl for engagement with said ratchet surfaces whereby pivotal motion of said lever assembly in one direction causes said magazine to move on said frame to effect said advancement, and pivotal movement of said lever assembly in the other direction retracts said pawl without imparting motion to said magazine.*

*33. The invention as defined in claim 32 including:*

*a unidirectional latch carried on said frame for engagement with said magazine to allow motion of said magazine in the direction imparted by said lever assembly and to prevent motion of said magazine in the opposite direction.*

*34. The invention as defined in claim 32 including:*

*a slide element operably carried for reciprocating movement on said frame;*

*said slide element engageable with said lever assembly to induce said pivotal movement of said lever assembly to effect said magazine advancement upon manual actuation of said slide element.*

*35. The invention as defined in claim 34 including:*

*a latch to hold said piston cocked against said propelling means;*

*a trigger for releasing said latch to actuate said piston propelling means;*

*said slide element when moved in the rearward direction being engageable with said piston so as to draw said position rearward for engagement with said latch.*

*36. The invention as defined in claim 28 including:*

*a trigger movably carried on said frame for actuation of said piston propelling means;*

*said magazine advancement means comprising a pawl carried on said trigger and a plurality of ratchet surfaces on said magazine;*

*said pawl being engageable with said ratchet surfaces whereby motion of said trigger in one direction is translated into advancing motion of said magazine.*

*37. The invention as defined in claim 36 including:*

*a cocking assembly comprising a pair of levers coupled about a pivot and operably carried on said frame;*

*said trigger being pivotally carried on said frame for travel between a rest position and a firing position, and provided with a shoulder engageable with one of said levers whereby pivotal motion of said trigger toward said firing position induces pivotal motion of said cocking assembly;*

*the other of said levers being engageable with said piston whereby said pivotal motion of said cocking assembly draws said piston rearward against said propelling means until angular displacement of said cocking assembly no longer allows simultaneous engagement of said cocking assembly with both said piston and said shoulder whereby said propelling means is allowed to drive said piston forward through said firing stroke.*

*38. The invention as defined in claim 21 wherein the means for moving said nozzle into said cocking position is operatively coupled to said means for retracting said piston.*

* * * * *